US008433516B1

(12) United States Patent
Gibbs et al.

(10) Patent No.: US 8,433,516 B1
(45) **Date of Patent: *Apr. 30, 2013**

(54) APPARATUS FOR ANALYSIS AND CONTROL OF A RECIPROCATING PUMP SYSTEM BY DETERMINATION OF A PUMP CARD

(75) Inventors: Sam G. Gibbs, Midland, TX (US); Doneil M. Dorado, Missouri City, TX (US); Kenneth B. Nolen, Midland, TX (US); Eric S. Oestreich, Richmond, TX (US); Jeffrey J. Dacunha, Midland, TX (US)

(73) Assignee: Lufkin Industries, Inc., Lufkin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/175,431

(22) Filed: Jul. 1, 2011

Related U.S. Application Data

(63) Continuation of application No. 12/290,477, filed on Oct. 31, 2008.

(51) Int. Cl.
*G01V 1/40* (2006.01)
*G06F 17/40* (2006.01)

(52) U.S. Cl.
USPC ..... 702/6; 702/187; 702/188; 702/189

(58) Field of Classification Search ..... 702/6–13, 702/119–124, 179–191, 193, 194; *G01V 1/40; G06F 17/40*
See application file for complete search history.

(56) References Cited

U.S. PATENT DOCUMENTS

| | | | | |
|---|---|---|---|---|
| 3,306,210 | A | 2/1967 | Boyd | |
| 3,343,409 | A | 9/1967 | Gibbs | |
| 5,252,031 | A * | 10/1993 | Gibbs | 417/53 |
| 5,431,230 | A | 7/1995 | Land | |
| 7,212,923 | B2 | 5/2007 | Gibbs et al. | |
| 8,036,829 | B2 | 10/2011 | Gibbs et al. | |
| 2005/0155759 | A1 * | 7/2005 | Bramlett et al. | 166/250.15 |

OTHER PUBLICATIONS

*Nolen and Gibbs*, et al. v. *Lufkin Industries, Inc., Andrews Kurth. LLP, and Gary L. Bush*; Cause No. CV-47,321; District Court of Midland Country, Texas 385th Judicial District Gibbs' Fourth Amended Petition; 53 pages; Mar. 24, 2011; U.S.A.

(Continued)

*Primary Examiner* — Phuong Huynh
(74) *Attorney, Agent, or Firm* — Greenberg Traurig, LLP; Ben D. Tobor

(57) ABSTRACT

An instrumentation system for assessing operation of a reciprocating pump system which produces hydrocarbons from a non-vertical or a vertical wellbore. The instrumentation system periodically produces a downhole pump card as a function of a directly or indirectly measured surface card and a friction law function from a wave equation which describes the linear vibrations in a long slender rod. A control signal or command signal is generated based on characteristics of the downhole pump card for controlling the pumping system. It also generates a pump and well analysis report that is useful for a pump operation and determination of its condition.

4 Claims, 11 Drawing Sheets

Fig. 4

OTHER PUBLICATIONS

*Nolen and Gibbs*, et al. v. *Lufkin Industries, Inc., Andrews Kurth, LLP, and Gary L. Bush*; Cause No. CV-47,321; District Court of Midland Country, Texas 385th Judicial District Noien's Fourth Amended Petition; 46 pages; Mar. 21, 2011; U.S.A.

Xu, J., "A Method for Diagnosing the Performance of Sucker Rod String in Straight Inclined Wells," Society of Petroleum Engineers International, SPE 26970, Tongji University.

Xu, Jun, "A New Approach to the Analysis of Deviated Rod-Pumped Wells," Society of Petroleum Engineers International, SPE 286979, Tongi University.

Dacunha, J.J., "Modeling a Finite-Length Sucker Rod Using the Semi-infinite Wave Equation and a Proof to Gibbs' Conjecture," SPE International, SPE 108762, Lufkin Automation.

International Search Report Issued in PCT/US2009/062185, Dec. 22, 2009.

Written Opinion of the International Searching Authority Issued in PCT/US2009/062185, Dec. 22, 2009.

* cited by examiner

APPARATUS FOR ANALYSIS AND CONTROL OF A RECIPROCATING PUMP SYSTEM BY DETERMINATION OF A PUMP CARD

RELATED APPLICATION

This application is a continuation of, and claims the benefit, and priority benefit, of U.S. patent application Ser. No. 12/290,477, filed Oct. 31, 2008, entitled "Apparatus for Analysis and Control of a Reciprocating Pump System by Determination of a Pump Card.

BACKGROUND OF THE INVENTION

1. Field of the Disclosure

This invention relates to apparatus which determines the performance characteristics of a pumping well. More particularly, the invention is directed to apparatus for determining downhole conditions of a sucker rod pump in a vertical borehole or deviated borehole from data which are received, measured and manipulated at the surface of the well. The invention also concerns the analysis of pumping problems in the operation of sucker rod pump systems in such boreholes. A vertical borehole is one that is substantially vertical into the earth, but a deviated borehole is one that is non-vertical into the earth from the surface. A deviated borehole may be a horizontal borehole which extends from a vertical portion thereof.

Still more particularly, the invention concerns an improved controller for analysis of downhole pump performance of a deviated borehole over the methods described in prior methods developed for nominally vertical borehole as described in Gibbs' U.S. Pat. No. 3,343,405 of Sep. 26, 1967.

2. Description of Prior Art

For pumping deep wells, such as oil wells, a common practice is to employ a series of interconnected rods for coupling an actuating device at the surface with a pump at the bottom of the well. This series of rods, generally referred to as the rod string or sucker rod, has the uppermost rod extending up through the well casinghead for connection with an actuating device, such as a pump jack of the walking beam type, through a coupling device generally referred to as the rod hanger. The well casinghead includes means for permitting sliding action of the uppermost rod which is generally referred to as the "polished rod."

FIG. 1 depicts a prior art rod pumping well, illustrated for a nominally vertical borehole. FIG. 2 depicts a prior art surface measurement arrangement by which a surface dynamometer ("card") is measured.

FIG. 1, shows a nominally vertical well having the usual well casing 10 extending from the surface to the bottom thereof. Positioned within the well casing 10 is a production tubing 11 having a pump 12 located at the lower end. The pump barrel 13 contains a standing valve 14 and a plunger or piston 15 which in turn contains a traveling valve 16. The plunger 15 is actuated by a jointed sucker rod 17 that extends from the piston 15 up through the production tubing to the surface and is connected at its upper end by a coupling 18 to a polished rod 19 which extends through a packing joint 20 in the wellhead.

FIG. 2, shows that the upper end of the polished rod 19 is connected to a hanger bar 23 suspended from a pumping beam 24 by two wire cables 25. The hanger bar 23 has a U-shaped slot 26 for receiving the polished rod 19. A latching gate 27 prevents the polished rod from moving out of the slot 26. A U-shaped platform 28 is held in place on top of the hanger bar 23 by means of a clamp 29. A similar clamp 30 is located below the hanger bar 23. A strain-gauge load cell 33 is bonded to the platform 28. An electrical cable 34 leads from the load cell 33 to an on-site well manager 50. A taut wire line 36 leads from the hanger bar 23 to a displacement transducer 37 (See FIG. 1). The displacement transducer 37 is also connected to the well manager 50 by the electrical lead 36'.

The strain-gauge load cell 33 is a conventional device and operates in a manner well known to those in the art. When the platform 28 is loaded, it becomes shorter and fatter due to a combination of axial and transverse strain. Since the wire of a strain-gauge 28 is bonded to the platform 28, it is also strained in a similar fashion. As a result, a current passed through the strain-gauge wire now has a larger cross section of wire in which to flow, and the wire is said to have less resistance. As the hanger bar 23 moves up and down, an electrical signal which relates strain-gauge resistance to polished rod load is transmitted from the load cell 33 to the well manager 50 via the electrical cable 34.

The displacement transducer 37 is a conventional device and operates in a manner well known to those of skill in the art of instrumentation. The displacement transducer unit 37 is a cable-and-reel driven, infinite resolution potentiometer that is equipped with a constant tension ("negator" spring driven) rewind assembly. As the hanger bar 23 moves up and down, the taut wire line 36 actuates the reel driven potentiometer and a varying voltage signal is produced. This signal, relates voltage to polished rod displacement, is also transmitted to the well manager 50. Other means for obtaining a displacement signal are well known in the art of determining performance characteristics of a pumping well.

Well manager 50 records the displacement signal as a function of time along with the rod load signal as a function of time.

In deep wells the long sucker rod has considerable stretch, distributed mass, etc., and motion at the pump end may be radically different from that imparted at the upper end. In the early years of rod pumping production, the polished rod dynamometer provided the principal means for analyzing the performance of rod pumped wells. A dynamometer is an instrument which records a curve, usually called a "card," of polished rod load versus displacement. The shape of the curve or "card" reflects the conditions which prevail downhole in the well. Hopefully the downhole conditions can be deduced by visual inspection of the polished rod card or "surface card." Owing to the diversity of card shapes, however, it was frequently impossible to make a diagnosis of downhole pump conditions solely on the basis of visual interpretation. In addition to being highly dependent on the skill of the dynamometer analyst, the method of visual interpretation only provides downhole data which are qualitative in nature. As a result it was frequently necessary to use complicated apparatus and procedures to directly take downhole measurements in order to accurately determine the performance characteristics at various depth levels within the well.

In 1936 W. E. Gilbert and S. B. Sargent disclosed an instrument which literally directly measured a subsurface dynamometer card. It was a mechanical device which was first run above the pump in the rod string. It allowed a small number of dynamometer cards to be collected before being recovered by pulling the rods to the surface. It scribed the pump card on a rotating tube, the angular position of which was made proportional to plunger position with respect to the tubing. Pump load was measured as proportional to the stretch of a calibrated rod within the instrument. Because the sucker rod had to be pulled to record the pump cards, the instrument was costly and cumbersome to use. But it provided valuable information relating the shape of the pump cards to various operating conditions known to exist in pumping wells such as full fillage, gas interference, fluid pound, pump malfunction, etc. The quantitative data that it provided allowed improvement of the methods for predicting pump stroke and the volumetric capability of the pump. The pump dynamometer device was a development that paved the way in the history of rod pumping technology.

With the dawn of the digital computer, S. G. Gibbs, a co-inventor of this invention, patented in 1967 (U.S. Pat. No. 3,343,409) a method for determining the downhole performance of a rod pumped well by measuring surface data, (the surface card) and computing a load versus displacement curve (a "pump card" for the sucker rod string at any selected depth in the well). As a result, the system provided a rational, economical, quantitative method for determining downhole conditions which is independent of the skill and experience of the analyst. It was no longer necessary to guess at downhole operating conditions on the basis of recordings taken several thousands of feet above the downhole pump at the polished rod at the surface, or to undertake the expensive and time consuming operation of running an instrument to the bottom of the well in order to measure such conditions. By use of the method, it became possible to directly determine the subsurface conditions from data received at the top of the well.

The 1967 patent, U.S. Pat. No. 3,343,409 of Gibbs, showed that an analysis of rod pumping performance begins with an accurate calculation of the downhole pump card. Gibbs showed that the calculation is based on a boundary-value problem comprising a partial differential equation and a set of boundary conditions.

The sucker rod is analogous mathematically to an electrical transmission or communication line, the behavior of which is described by the viscously damped wave equation:

$$\frac{\partial^2 u(x,t)}{\partial t^2} = v^2 \frac{\partial^2 u(x,t)}{\partial x^2} - c\frac{\partial u(x,t)}{\partial t} + g \tag{1}$$

where:

v=velocity of sound in steel in feet/second;

c=damping coefficient, 1/second;

t=time in seconds;

x=distance of a point on the unrestrained rod measured from the polished rod in feet; and, u(x,t)=displacement from the equilibrium position of the sucker rod in feet, g=weight of pump rod assembly.

In reality, damping in a sucker rod system is a complicated mixture of many effects. The viscous damping law postulated in Equation 1 lumps all of these damping effects into an equivalent viscous damping term. The criterion of equivalence is that the equivalent force removes from the system as much energy per cycle as that removed by the real damping forces.

FIG. 1 shows that a pump 200 can be controlled based on a downhole "pump" card. U.S. Pat. No. 5,252,031 to S. G. Gibbs illustrates generation of control signals based on pump card determination. U.S. Pat. No. 6,857,474 by Bramlett et al. describes control of a pump based on pattern recognition of a pump card to analyze pump operation and control thereof. Such patents are incorporated by reference herein.

The wave equation, a second order partial differential equation in two independent variables (distance x and time t), models the elastic behavior of a long, slender rod such as used in rod pumping. As discussed in SPE paper 108762 titled, "Modeling a Finite Length Sucker Rod Using the Semi-Infinite Wave Equation and as Proof to Gibbs' Conjecture," SPE 2007 Annual Technical Conference, Anaheim, Calif., 11-14, November 2007, J. J. DaCunha and S. G. Gibbs. Normally the problem to be solved with the wave equation involves boundary conditions specifying position at the top, and strain at the top and bottom of the rod string, $$u(0,t) = P(t),\ \alpha u(L,t) + \beta\frac{\partial u}{\partial x}(L,t) = J(t),\ \alpha,\ \beta \in R, \tag{2}$$

together with two conditions specifying initial position and velocity, $$u(x,0) = f(x),\ \frac{\partial u}{\partial t}(x,0) = g(x) \tag{3}$$

along the rods. For the sucker rod problem the damping law in the wave equation was chosen primarily for mathematical tractability even though it did not rigorously mimic the real dissipation effects along the sucker rod.

The boundary value problem that led to computation of downhole pump cards is incompletely stated. The initial conditions in Equation (3) above are ignored. It is presumed that friction damps out the initial transients, and the steady state behavior of the rod string is the same regardless of how the pumping system is started. No assumptions are made about conditions at the downhole pump. After all, determination of these conditions is the object of the solution. Thus, no boundary conditions analogous to Equation (2) above are specified at the pump. Instead, two boundary conditions are enforced at the surface, $$u(0,t) = P(t),\ EA\frac{\partial u}{\partial x}(L,t) = L(t), \tag{4}$$

where E and A are the Young's modulus and the cross-sectional area of the rod string, respectively. Using digital methods, the time histories P(t) and L(t) are sampled at equal time increments and expressed as truncated Fourier series $$P(t) = \varphi_0 + \sum_{n=1}^{m} \varphi_n \cos(n\omega t) + \delta_n \sin(n\omega t), \tag{5}$$

$$L(t) = \sigma_0 + \sum_{n=1}^{m} \sigma_n \cos(n\omega t) + \tau_n \sin(n\omega t). \tag{6}$$

Using separation of variables, solutions to the wave equation are sought which satisfy the measured time histories of surface position and load. The resulting solutions for rod position and rod load, i.e.

$$u(x,t) \text{ and } EA\frac{\partial u}{\partial x}(x,t), \tag{7}$$

respectively, are evaluated at a specific depth and at a succession of times to produce the downhole pump card. See for example the computed card in a 5175 ft well shown in FIG. 3. The illustration also shows the measured surface data (in conventional dynamometer card form) from which the pump card is deduced. The method of computing downhole pump cards with the wave equation is described in the Gibbs patent referenced above. FIG. 3 shows prior art surface and pump card plots for a vertical well using the Gibbs method of calculating the pump card based on the surface card measured data.

Using empirical evidence, the wave equation solution outlined above was conjectured to be valid in spite of theoretical questions surrounding the incompletely stated problem from whence it came. It could be used to determine conditions at the pump if the friction law incorporated into the wave equation was correct. The conjecture is formally stated as the Gibbs' Conjecture.

> Solutions of the wave equation which match measured time histories of surface load and position will produce the exact downhole pump card if the friction law in the wave equation is perfect. In computing the pump card, no knowledge of pump conditions is required. Any error in the friction law will cause error in the computed pump card.

The paper (SPE 108762) mentioned above shows a non-constructive mathematical proof that downhole conditions in a finite rod string can be inferred from measurements at the top of a semi-infinite rod. The proof is developed by realizing that the laws of physics demand that information about downhole pump conditions propagate to the surface in the form of stress waves. A key element in the proof, (and now the Gibbs' Theorem) is that the exact law of rod friction must be known. Even though the non-constructive proof does not reveal the exact law, the proof does show how the process can be used to refine the friction law to attain more accuracy in computing downhole conditions.

The term $$c\frac{\partial u(x,t)}{\partial t}$$

is the fluid friction term representing the opposing force of the fluid against axial motion of the pump. In its simplest form, it prescribes a frictional force that is proportional to speed. No other rod frictional forces are presumed to exist. The g term represents rod weight. In other words the mathematical modeling of a rod pump as described by equation (1) presumes a nominally vertical well where tubing drag forces are assumed not to exist.

The qualifying word nominally is used because it is impossible to drill a perfectly vertical well. As weight is applied on the bit to achieve penetration, the drill string buckles somewhat and the borehole departs somewhat from the vertical. When a well is intended to be vertical, the oil producer includes a deviation clause in the agreement with the drilling contractor stipulating that the borehole be vertical within narrow limits. Vertical wells are easier to produce with rod pumping equipment because rod friction is less. The rod string transmits energy from the surface unit to the down hole pump which lifts fluid to the surface. Friction causes a loss in pump stroke and as a result decreases lifting capacity. Also it causes wear and tear on rods and tubing.

The practice of including deviation clauses in drilling contracts and the technology of measuring borehole path came about because of scandals in the oil industry. Unscrupulous oil producers were intentionally draining oil reserves owned by neighboring leaseholders using slanted wells.

Deviated wells are becoming more common. In these wells, the point where (in plan view) fluid from the reservoir enters the borehole can be considerably displaced laterally from the surface location. The deviation can be unintended or intentional as described above.

The reasons for intentionally deviated wells are many and varied. Most reasons follow from environmental or social considerations. Along a shoreline, wells with onshore surface locations can be deviated to drain reservoirs beneath bodies of water. Similarly oil beneath residential or metropolitan areas can be produced with deviated wells having their surface locations outside the sensitive areas. Oil and gas production requires vehicular traffic to service the wells. Deviated wells can diminish unwanted traffic in residential areas because only the surface locations need be serviced. The reach of deviated wells can be thousands of feet (in plan view) from the surface location. Multiple vertical wells require multiple surface roads to each location. A case in point could be ANWAR (Arctic National Wildlife Refuge). Using deviated wells, access roads to each well would not be necessary. Twenty or more deviated wells can be clumped together in a small area so as to produce a minimal environmental impact. A single access road to the small surface location would then suffice. Twenty different access rods to each well (if drilled vertically) would not be needed. Owing to these many reasons, the number of deviated wells has (and will continue to) increase rapidly.

Measuring and controlling the borehole path has become very sophisticated. Various telemetry methods are used to transmit triplets of data (depth, azimuth and inclination) to the surface. These are the items required to produce a deviation survey.

IDENTIFICATION OF OBJECTS OF THE INVENTION

A primary object of this invention is to provide an improved controller which determines a down-hole pump card for a deviated well from surface measurements.

Another object of the invention is to provide a well-controller that uses a down-hole pump card for a deviated well for control of a rod pump.

Another object of the invention is to provide an improved controller which can be used for determining a down-hole pump card for a deviated well and for a vertical well from surface measurements.

SUMMARY OF THE INVENTION

The objects of the invention along with other features and advantages are incorporated in a system for monitoring a reciprocating pump system which produces hydrocarbons from a non-vertical wellbore or a vertical wellbore which extends from the surface into the earth. A data gathering system is part of the system which provides signals representative of surface operating characteristics of the pumping system and characteristics of a non-vertical wellbore, such characteristics including depth, azimuth and inclination. A processor is provided which receives the operating characteristics with the characteristics of the non-vertical wellbore and generates a surface card representative of polished rod load as a function of surface polished rod position. The processor generates a friction law function based on the characteristics of the non-vertical wellbore. The processor generates a down-hole pump card as a function of the surface card and the friction law function for a wave equation which describes the linear vibrations in a long slender rod.

The processor further includes pump card analysis software which produces a control signal for control of the pump system.

The wave equation for a non-vertical well is of the form $$\frac{\partial^2 u(x,t)}{\partial t^t} = v^2 \frac{\partial^2 u(x,t)}{\partial x^2} - c\frac{\partial u(x,t)}{\partial t} - C(x) + g(x) \tag{8}$$

in which $$C(x) = \delta\mu(x)\left[Q(x) + T(x)\frac{\partial u(x,t)}{\partial x}\right] \tag{9}$$

$$\delta = \frac{\partial u(x,t)/\partial t}{|\partial u(x,t)/\partial t|} \tag{10}$$

where C(x) represents rod or tubing drag force.

The controller can also be used for a nominally vertical wellbore using equations (8)-(10) where C(x) is modified to correspond to such a vertical wellbore.

BRIEF DESCRIPTION OF THE DRAWINGS

The invention is described below with reference to the accompanying drawings of which.

DESCRIPTION OF THE INVENTION

Figure 1:
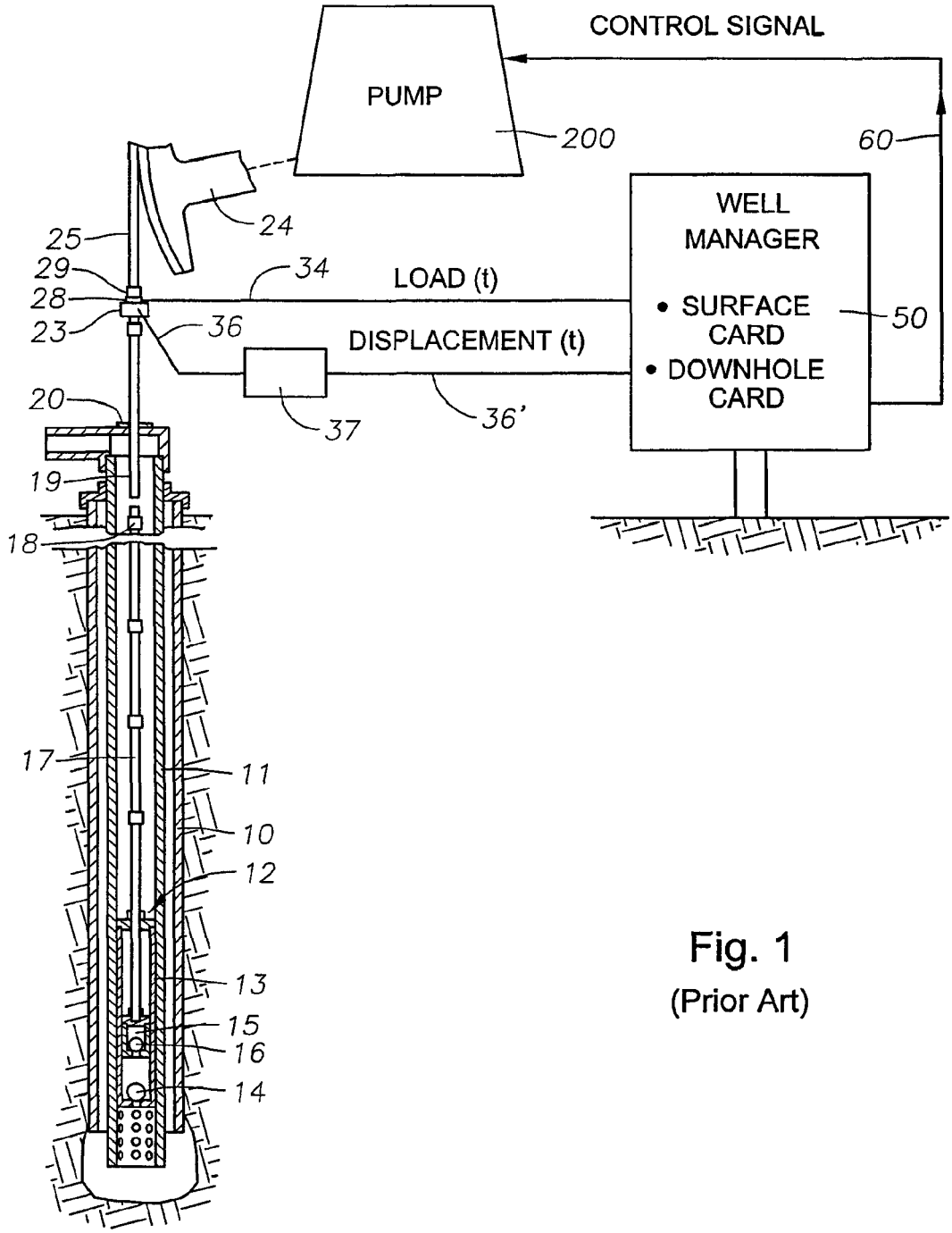
Fig. 1 (Prior Art)
FIG. 1 is a schematic diagram partially in longitudinal section, showing the general arrangement of prior art apparatus in a nominally vertical well.
Figure 2:
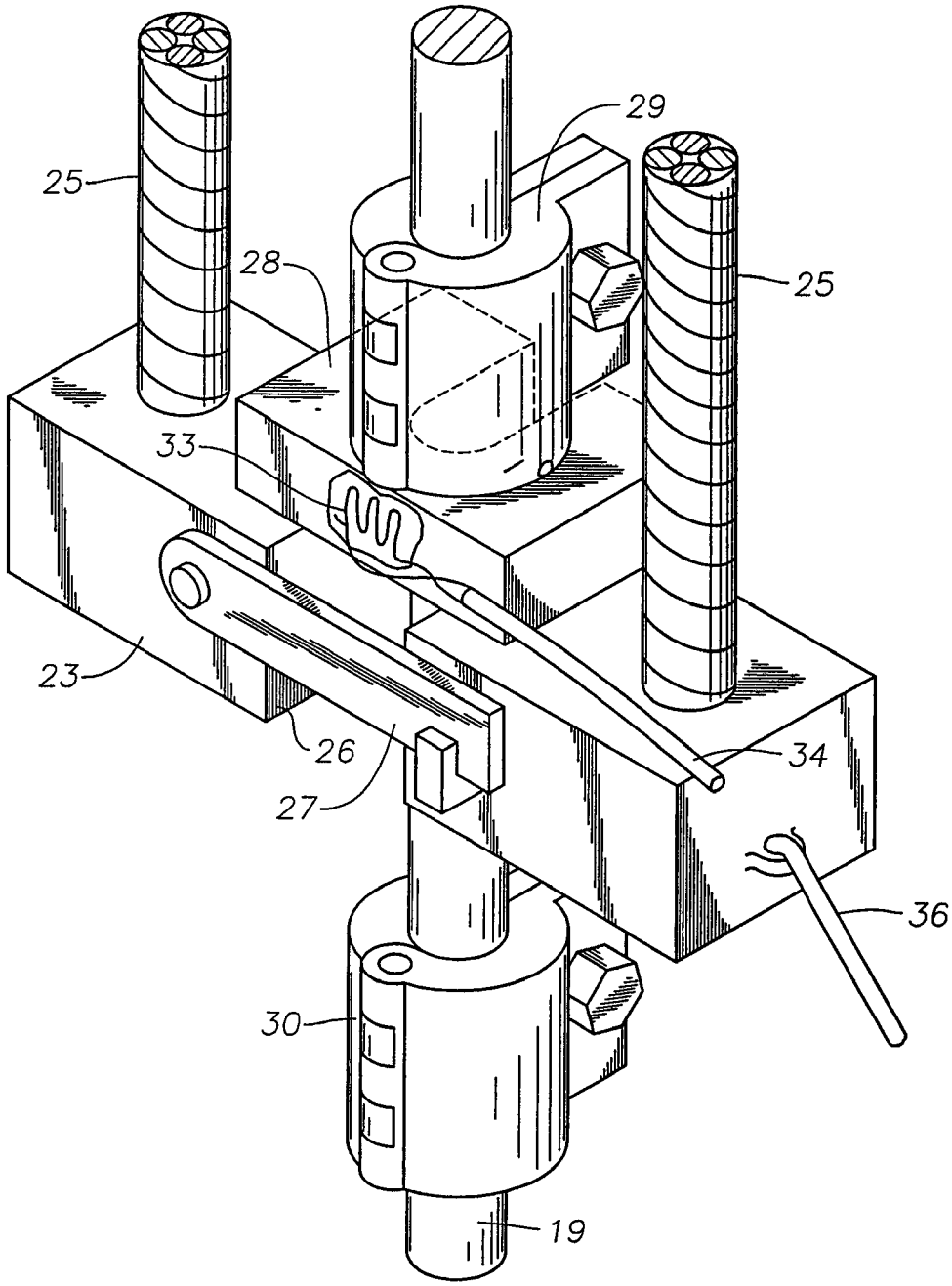
Fig. 2 (Prior Art)
FIG. 2 is an enlarged side elevation view showing the general arrangement of a portion of the apparatus at the rod hanger.
Figure 3:
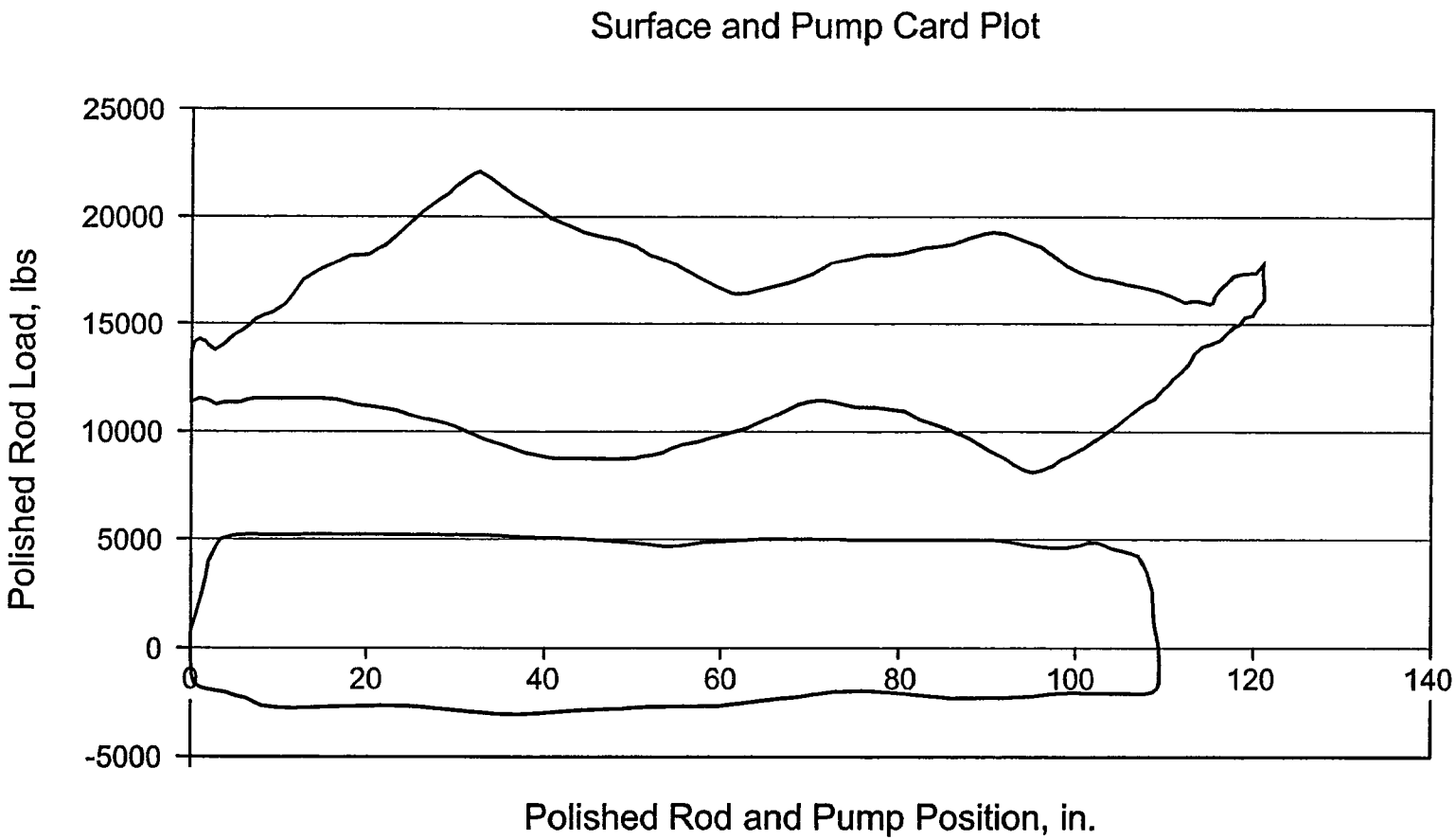
Fig. 3 (Prior Art)
FIG. 3 is a prior art graph showing a surface card and computed downhole pump card for a nominally vertical well.
Figure 4:
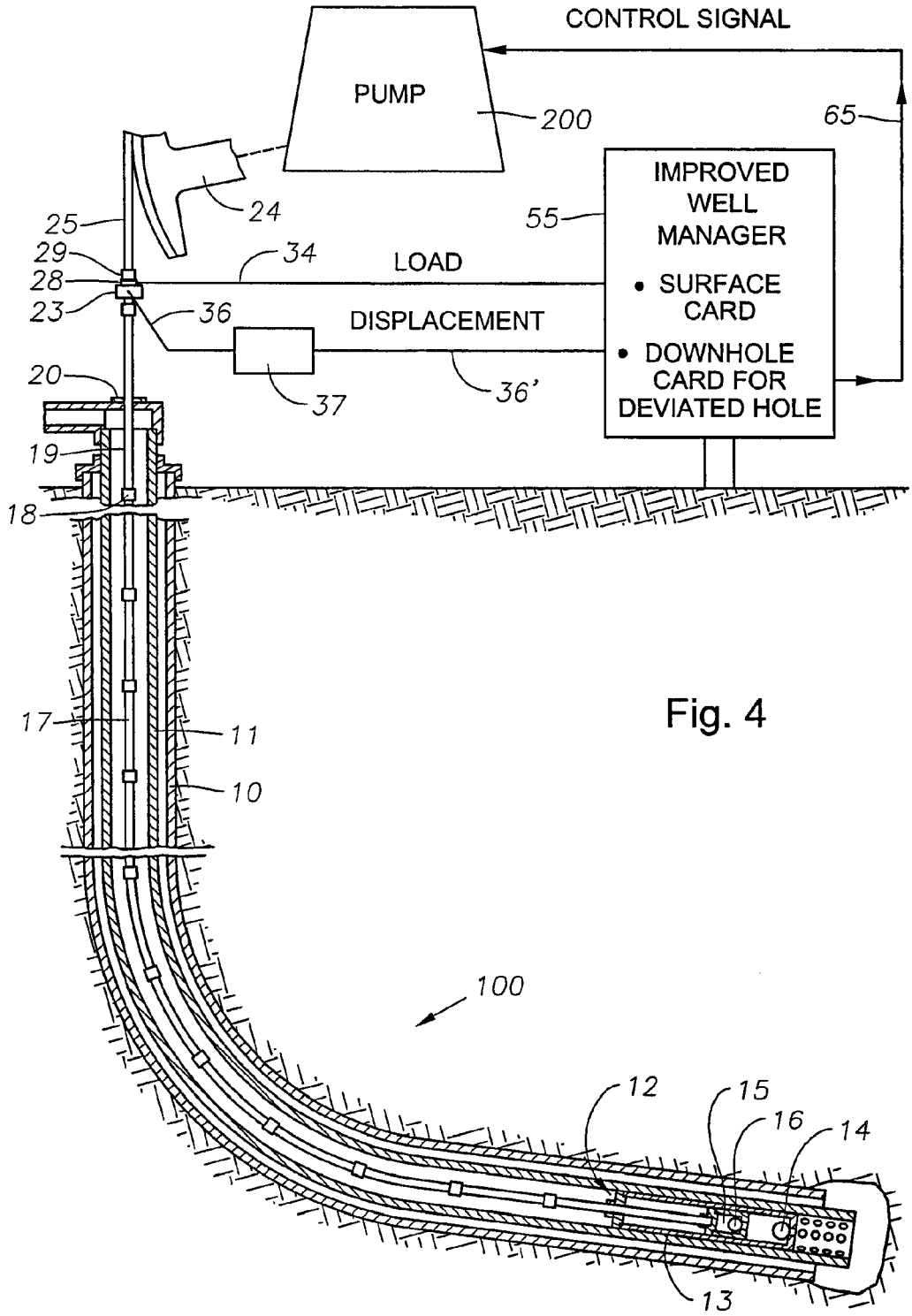
FIG. 4 illustrates a deviated borehole with an improved well manager for determination of a downhole card for a deviated well according to the invention.

FIG. 4 illustrates a sucker rod pump operating in a deviated hole 100. The reference numbers for the casing, pump, sucker rods, etc. of FIG. 4 are the same as for the illustration of FIG. 1 for a vertical hole, but load signals 34 and displacement signals 36' are applied (either by hardwire or wireless) to an Improved Well manager 55 for determination of a surface card and a downhole card for the deviated hole 100. A control signal 65 is generated in the improved well manager 55 and applied to the pump 200, by hardwire or wireless.

A deviated well like that of FIG. 4 requires a different version of the wave equation which models the more complicated rod on tubing drag forces, $$\frac{\partial^2 u(x,t)}{\partial t^t} = v^2 \frac{\partial^2 u(x,t)}{\partial x^2} - c\frac{\partial u(x,t)}{\partial t} - C(x) + g(x) \tag{8}$$

in which $$C(x) = \delta\mu(x)\left[Q(x) + T(x)\frac{\partial u(x,t)}{\partial x}\right] \tag{9}$$

$$\delta = \frac{\partial u(x,t)/\partial t}{|\partial u(x,t)/\partial t|} \tag{10}$$

where v=velocity of sound in steel in feet/second;

c=damping coefficient, 1/second;

t=time in seconds;

x=distance of a point on the unrestrained rod measured from the polished rod in feet;

u(x,t)=displacement from the equilibrium position of the sucker rod in feet at the time t, and g(x)=rod weight component in x direction.

The term C(x) represents the rod 17 on tubing 11 drag force. The rod weight term g(x) is generalized to the non-vertical case where only the component of rod weight contributes to axial force in the rods. The direction of axial forces in the rod is determined from depth, azimuth and inclination signals from the deviation survey, obtained where the borehole is drilled. In deviated wells, rod guides are used in a sacrificial fashion to absorb the wear that would otherwise be inflicted on rods and tubing. The function μ(x) allows variation of friction along the rods 17 depending upon whether rod guides or bare rods are in contact with the tubing 11. The δ operator insures that frictional forces always act opposite to rod motion. Side forces in curved portions of the rod string are modeled by the function Q(x). A strain dependent function acts also in a direction opposite the direction of motion and is represented by $$T(x)\frac{\partial u(x,t)}{\partial x}.$$

Fluid friction is modeled by the term $$c\frac{\partial u(x,t)}{\partial t}$$

in the same manner as in a vertical well. The friction coefficient μ is defined as $$\mu = \frac{\text{rod on tubing drag}}{\text{side force between rod and tubing}} \tag{10.1}$$

The friction coefficient varies with lubricity and contacting materials (e.g., rod guides, base steel, etc.). It can be estimated, measured or determined by performance matching.

In equations (8), (9), (10), the friction coefficient μ is allowed to vary along the rod string according to the contacting surfaces.

Determination of μ(x), Q(x) and T(x) by Mathematical Modeling of a Rod String

Figure 8:
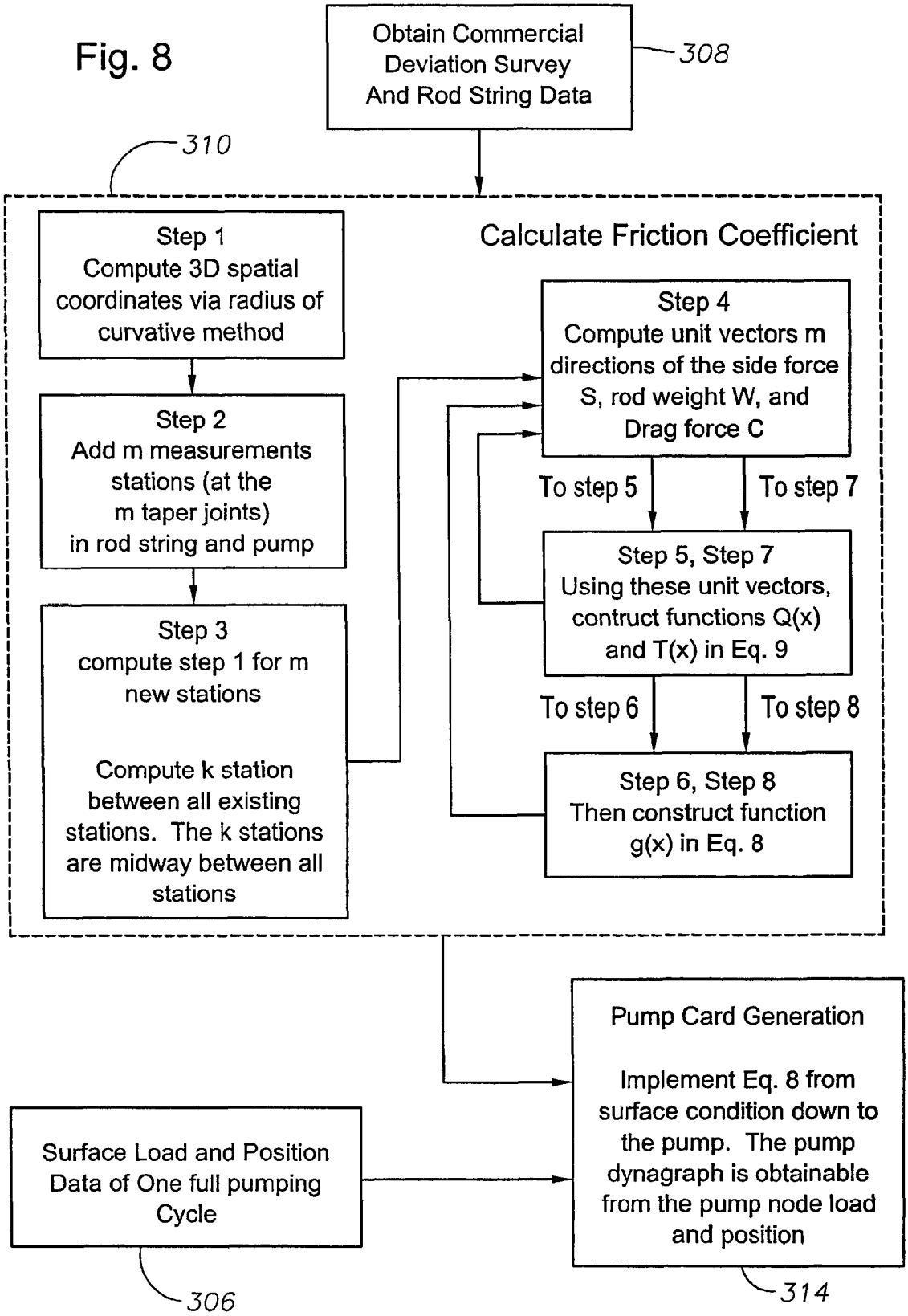
FIG. 8 illustrates steps for calculation of the friction coefficient for modeling of a deviated well.

The function μ(x), and the functions Q(x) and T(x) are first determined in mathematical models of a computer simulation. In straight portions of the borehole, Q(x)≠0, and T(x)=0. In curved portions, Q(x)=0 and T(x)≠0. The simulation follows eight steps, as outlined in computational logic boxes 308, 310 of FIG. 8 and described as follows:

Step 1. Start with a commercial deviation survey (e.g., from logic box 308) comprised of measured depth (ft along the borehole path), inclination from vertical (deg) and azimuth from north (deg). This survey contains a number of measurement stations. Compute 3D spatial coordinates (x, y, z) of each station using any method. A (vector) radius of curvature method is preferred. See FIG. 4A. Compute (unit) tangent vectors, true vertical depth and centers of curvature for each measurement station and pair of measurement stations.

Step 2. Add measurement stations at taper points in the rod string and at the pump. The new stations should fall on the arc defined by the center of curvature of the station above and below the new station. Compute the same quantities described in Step 1.

Figure 4A:
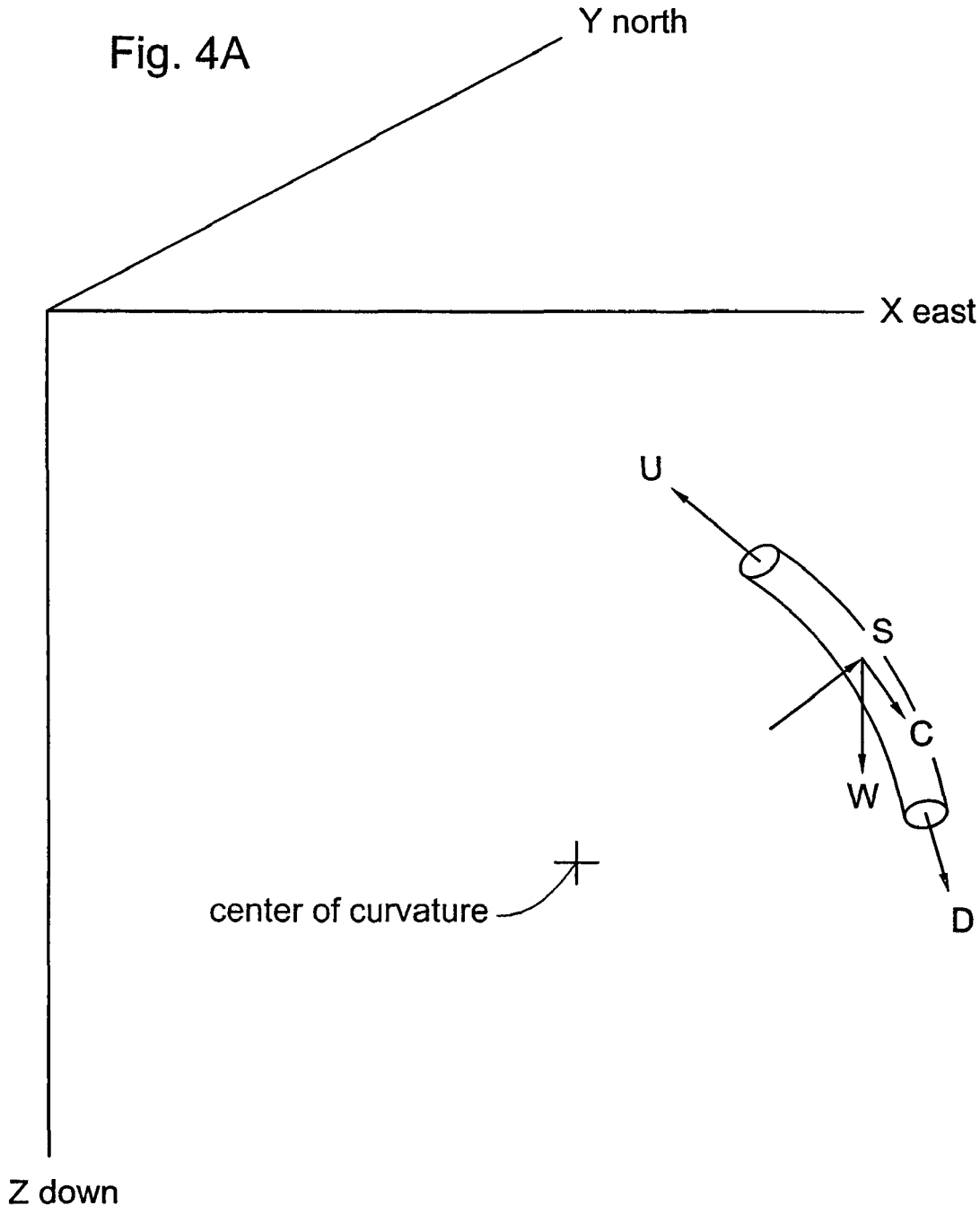
FIG. 4A illustrates vector components at a section of a deviated well.

Step 3. Add still more measurement stations at mid-points between pairs of measurement stations described in Steps 2. The mid-point stations should fall on the arc defined by the center of curvature of the stations above and below. Compute (unit) vectors which define the direction of the side force S, the rod weight force W and the drag force C as illustrated in FIG. 4A.

Step 4. Apply a downward acting force at the pump node (say 5000 lb) whose direction is defined by the unit tangent vector at the pump. On FIG. 4A this is the vector D. Compute the side force S, the drag force C and the upward acting axial force U from the vector equations $$U + W + D + S + C = 0 \tag{10.2}$$

$$|C| = \mu|S| \tag{10.3}$$

The symbol || denotes the absolute magnitude of the vector within. The weight vector W always acts downward and has a magnitude w Δx, where w is the unit weight of rods (lb/ft) and Δx is the length of rods between the measurement stations.

Step 5. Continue the process by moving upward to the next mid-point station. The negative of the upward axial force vector U in Step 4 becomes the downward axial force vector D. Return to Step 4 until the top of the rod string is reached. Record the results determined at each mid-point station. Then proceed to Step 6.

Step 6. Return to Step 4 and repeat the process (Steps 4 and 5) except start with a larger load at the pump, say 10000 lbf. This second experiment helps determine the sensitivity of side load (hence drag) with axial load in the rods.

Step 7. Using the recorded information, construct the functions Q(x) and T(x) shown in Eq. 10.

Step 8. Using the recorded information, construct the rod weight function g(x) of Eq. 8.

Designing or Diagnosing a Deviated Rod-Pumped Well

Figure 5A:
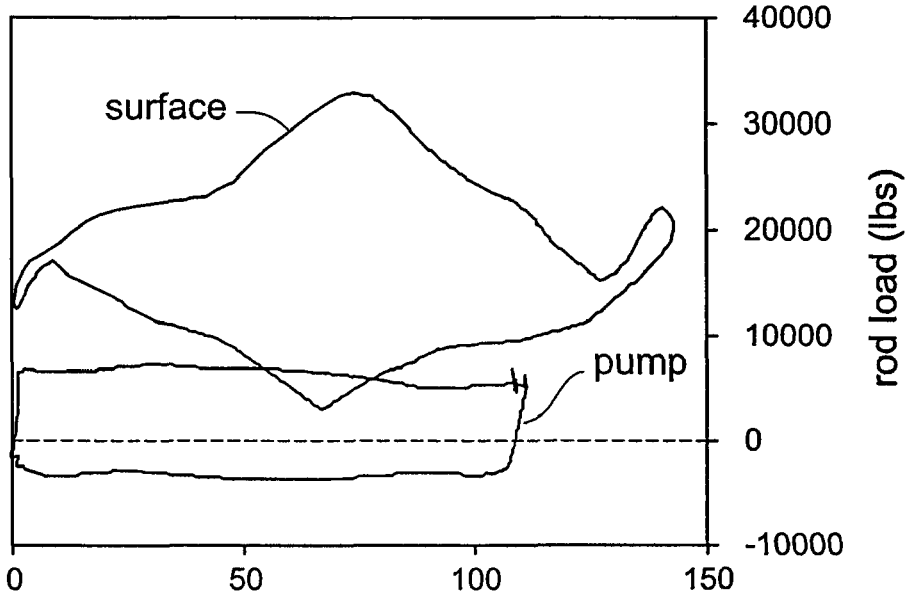
FIG. 5A illustrates a pump card computed in a deviated well using the methods of this invention, and by comparison.
Figure 5B:
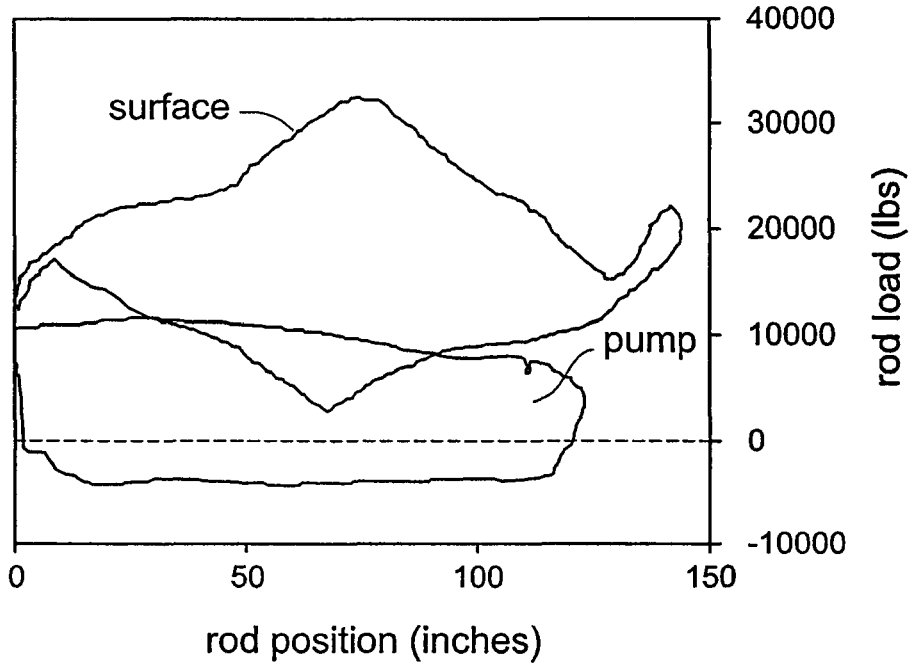
FIG. 5B illustrates a pump card of the same deviated well computed with the prior art methods assuming a vertical well.

The wave equation (Eg. 8, with Eg. 9 and Eg. 10) is used to design or diagnose deviated wells. When used to design, assumptions about down hole conditions are made to allow prediction of the performance of a rod pumping installation. In the diagnostic sense, the wave equation is used to infer down hole conditions using dynamometer data gathered at the surface. Large predictive or diagnostic errors result if rod friction is not modeled properly. This is illustrated by reference to FIGS. 5A and 5B. The object is to compute the down hole pump card from surface data (i.e. the diagnostic problem). FIG. 5A shows the pump card computed in a deviated well using eq. 8. FIG. 5B shows the pump card computed with eq. 1 as if the well were vertical. The pump card in FIG. 5B is incorrect. The indicated pump stroke is too long and pump loads are too large. Also the shape of the pump card is distorted. The pump card in FIG. 5B is a graphical indication of the Gibbs Theorem as described above.

One way to determine an accurate pump card for the deviated well of FIG. 4 is to segment the well and provide upper and lower cards for each segment. The lower card for an upper segment serves as the upper card for the lower segment, and so on until the card at the pump (or desired point in the well) is determined. Each segment is characterized by a different side force Q(x) function correspondingly to a curved segment of the rod string.

Using hypothetical data, it is possible to show how to reverse engineer a more complicated friction law for the deviated well. The example presented below applies to shallow wells in which local velocity is essentially the same at all depths along the rod string. The last sentence in the Gibbs Theorem, "Any error in the friction law will cause error in the computed pump card", describes the procedure. The largest possible error is deliberately made in the computed pump card by setting friction to zero in a hypothetical well with a 2.50 inch pump set at 3375 ft. A C640-305-144 pump jack unit is operating the installation at 8.81 strokes per minute. Linear friction along the rod string is prescribed to be 0.158 lb per ft of rod length per ft/sec of rod velocity. Thus if the well is shallow such that rod velocity is about the same all along the rod, total velocity dependent friction at 5 ft/sec will be 2666 lb [0.158 (3375) (5)=2666]. Velocity dependent friction acts opposite to the direction of motion. In addition a Coulomb component (independent of speed but always opposite to the direction of motion) of 0.3 lb/ft of rod length is prescribed. Thus the total Coulomb drag along the entire rod string will be 1013 lbs [0.3 (3375)=1013]. When the rods are moving upward at 5 ft/sec a downward force of 3679 lb will be acting. When the rods are moving downward at 5 ft/sec an upward frictional force of 3679 lb will be applied. The friction law used to create the hypothetical data can be written $$F = -0.158(3375)V - 0.3(3375)\frac{V}{|V|}. \tag{11}$$

Figure 6A:
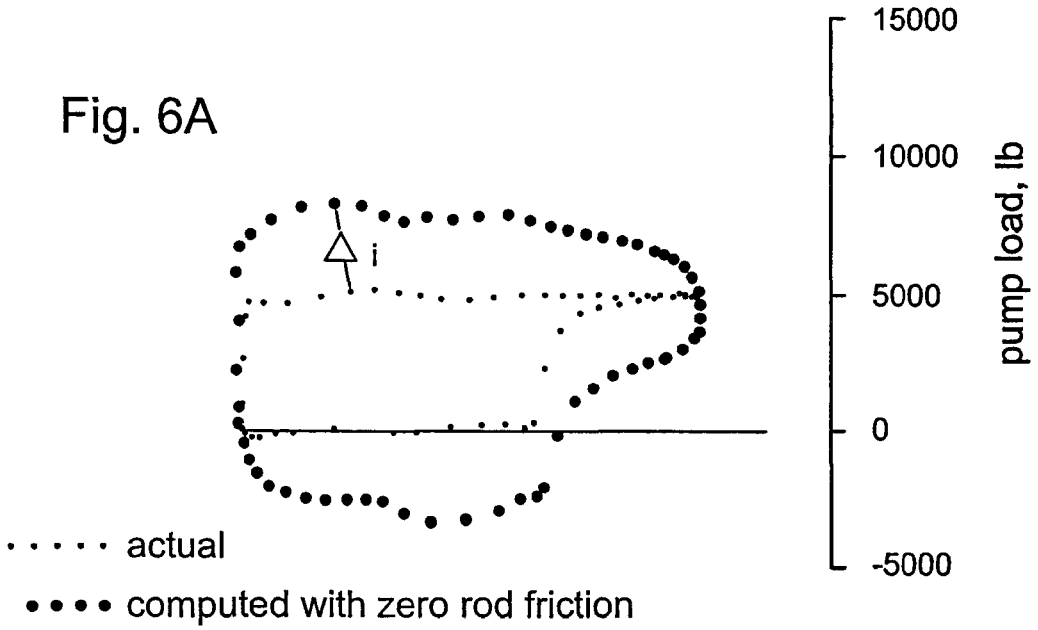
FIGS. 6A, 6B, and 6C graphically illustrate a procedure to reverse engineer a friction law for a deviated well.

FIG. 6A shows two pump cards plotted to the same load and position scales and with a common time origin. Sixty points are used to plot each card with a constant time interval between points. An error function is defined by $$\Delta_i = L_a(t_i) - L_0(t_i), \tag{12}$$

wherein the $L_a(t_i)$ are actual (true) pump loads created by the completely stated predictive program and the $L_o(t_i)$ are pump loads calculated with the Diagnostic Technique with zero friction. The $\Delta_i$ measure the error caused by using an incorrect friction law (zero friction) according to the Gibbs Theorem. Since rod friction was set to zero and velocity along the rods is essentially the same at a given time (shallow well), $\Delta_i$ represents the total friction along the length of the rod string.

Figure 6B:
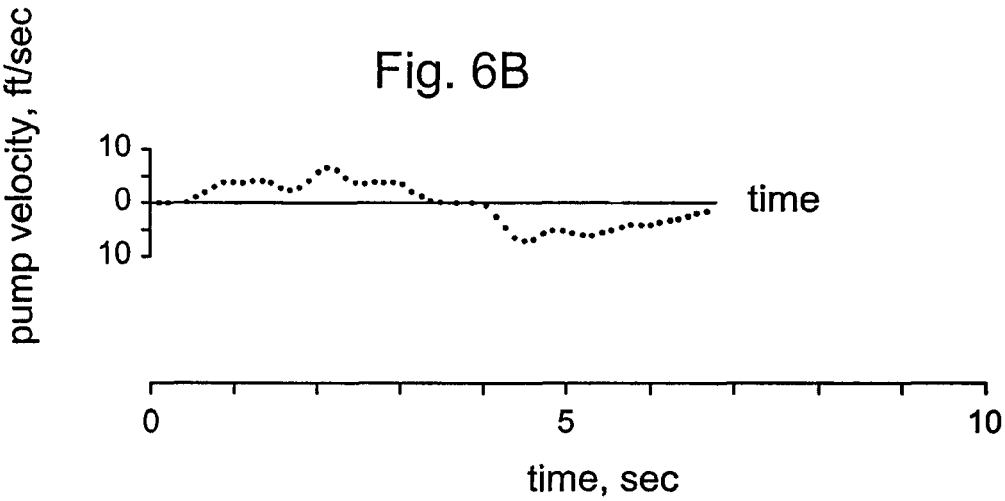

FIG. 6*b* shows a time history of pump velocity which is taken to be representative of local velocity everywhere along the rod string.

Figure 6C:
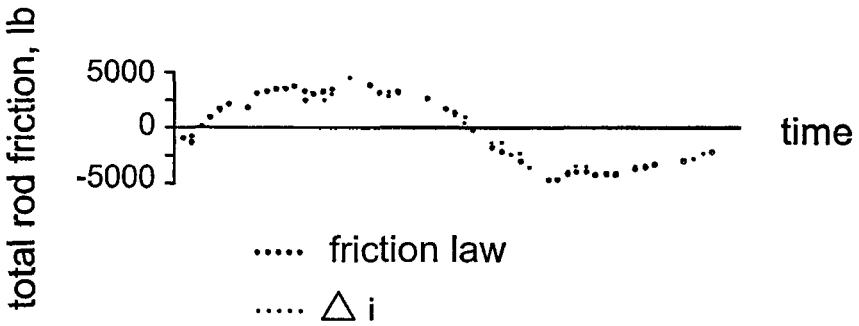

Finally FIG. 6*c* shows a time history of $\Delta_i$ and a time history of the friction law Equation (12) used to create the hypothetical example. The agreement between the two time histories is close but not perfect. The imperfections are caused by the fact that even in a shallow well the rod string stretches such that an idealization of equal velocities along its length is not strictly true. Still the agreement is close enough to indicate that the Gibbs Theorem can be used to define more complicated friction laws.

Figure 7A:
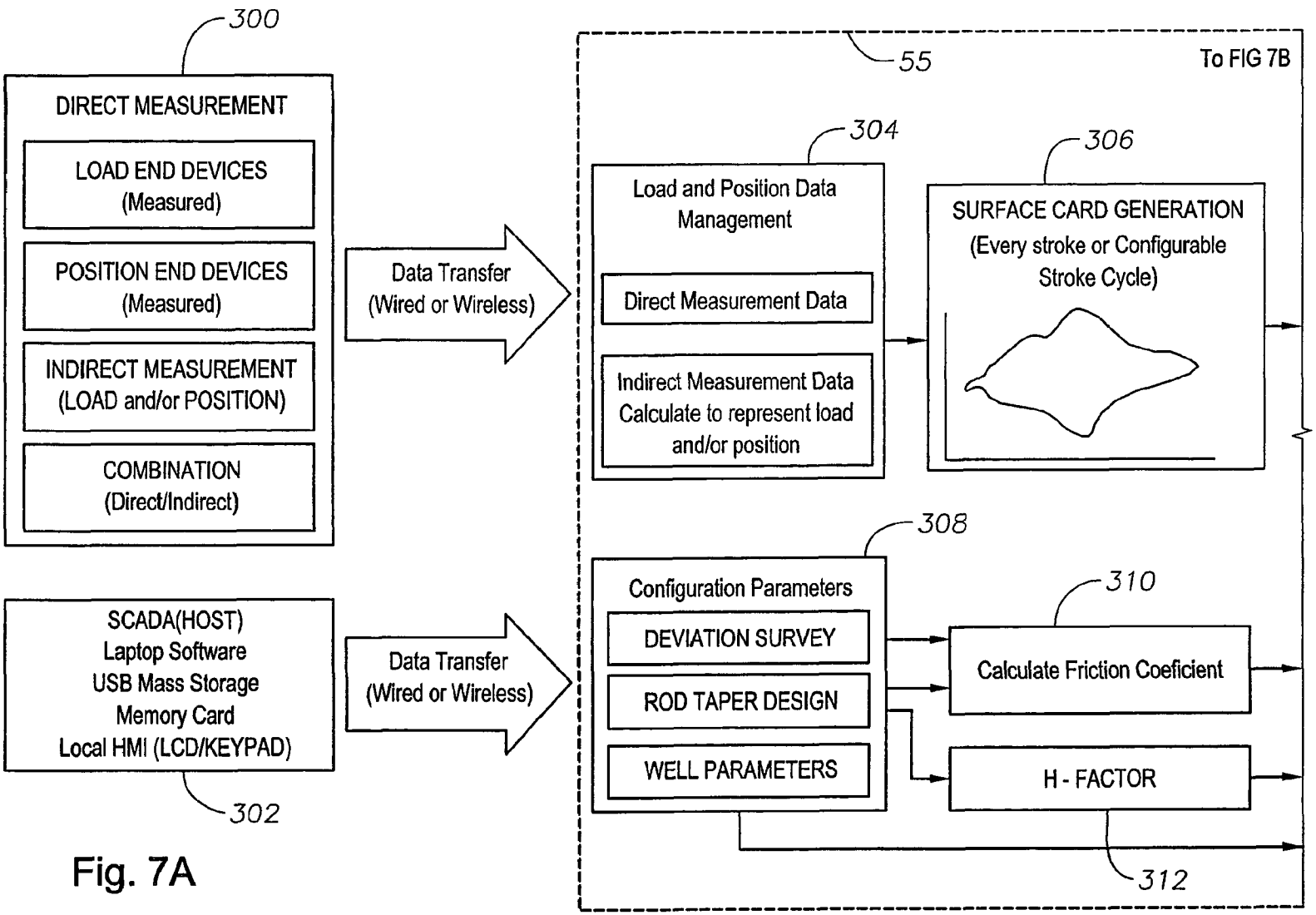
FIGS. 7A, 7B, and 7C show flow charts of computations and functions accomplished in an improved well manager for control of a pump in a deviated well.
Figure 7B:
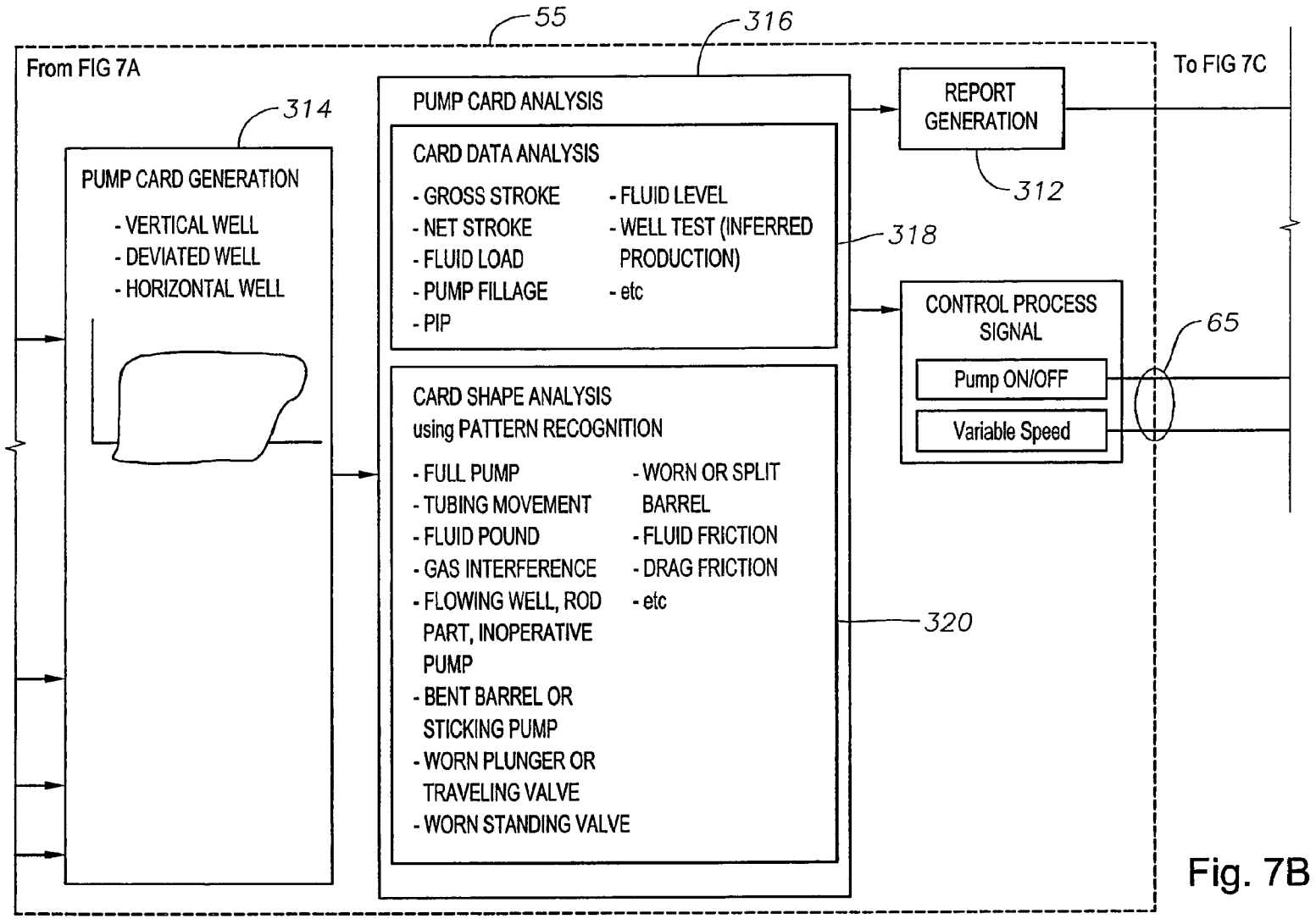
Figure 7C:
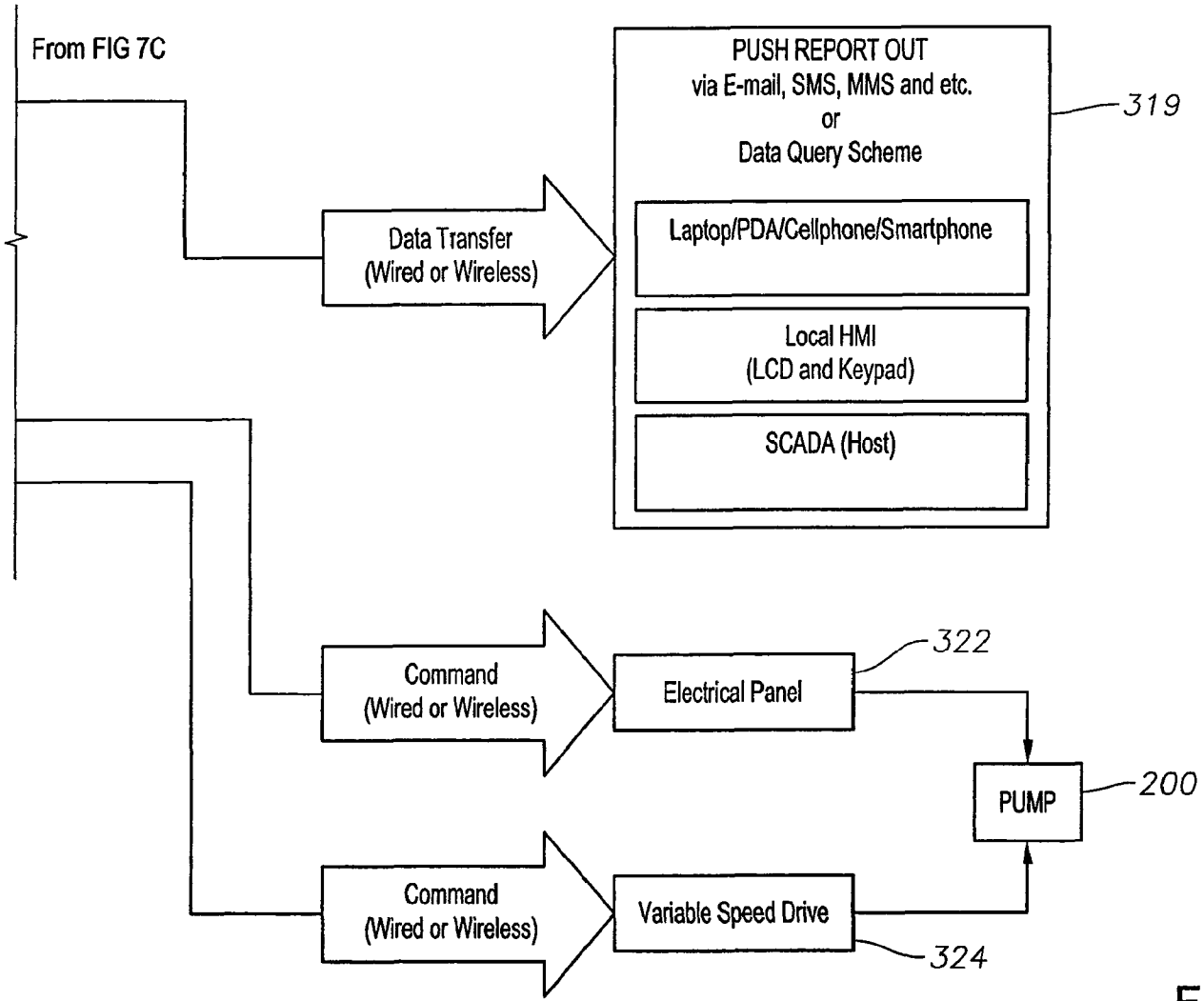

FIGS. 7A and 7B schematically illustrate in flow chart fashion the functions of the improved well manger device 55. FIG. 7A shows in Logic box 300 that load and position data which is directly measured (e.g., load data by load cell and position data by string potentiometer, inclinometer, laser, RF, Radar distance/position measuring sensor, etc.) or indirectly measured (i.e. calculated based on other inputs). Such data is applied to logic box 304 where load and position data are managed and configured. The data is passed to a surface card generator 306 where position and load data are correlated for each cycle of reciprocation of the rod pump.

Logic box 302 illustrates that data input from various devices are transferred to logic box 308 where data about the pump and well are stored. The deviation survey includes depth, azimuth and inclination data at each point along the well. The rod taper design information and deviation survey are used to calculate the friction coefficient as described above by reference to FIG. 8 for calculation of a pump card of a deviated well or a horizontal well. Rod taper design information is used in logic box 312 to determine the H-factor useful in pump card generation of logic box 314.

Determination of H Factors Used to Provide a Numerical Solution of the Wave Equation The H factors are non-dimensional coefficients for nodal rod positions used in the numerical solution of the wave equation. They do not vary with time and can thus be pre-computed before the real time solution begins. This saves computer time and helps make feasible the implementation of the process on microcomputers at the well site. Begin with the wave equation for deviated wells $$\frac{\partial^2 u(x,t)}{\partial t^2} = v^2 \frac{\partial^2 u(x,t)}{\partial x^2} - c\frac{\partial u(x,t)}{\partial t} - C(x) + g(x) \quad \text{(8) repeated}$$

The H factors are obtained by replacing the partial derivatives in eq. (8) by partial difference approximations as follows:

$$\frac{\partial^2 u(x,t)}{\partial t^2} \equiv \frac{u(x,t+\Delta t) - 2u(x,t) + u(x,t-\Delta t)}{\Delta t^2} \quad (10.4)$$

$$\frac{\partial^2 u(x,t)}{\partial x^2} \equiv \frac{u(x,t+\Delta s,\ t) - 2u(x,t) + u(x-\Delta x,t)}{\Delta x^2} + \left[\frac{\Delta x^2}{v^2\Delta t^2}\right] u(x,t-\Delta t) - u(x-\Delta x,t) \quad (10.5)$$

The forward difference form of equation 10.5 is of the form, $$u(x+\Delta x,t) = H_1 u(x,t+\Delta t) - H_2 u(x,t) + H_3 u(x,t-\Delta t) - u(x-\Delta x,t)$$

in which $$H_1 = \frac{\Delta s^2}{v^2\Delta t^2} + \frac{c\Delta s^2}{v^2\Delta t} \quad (10.8)$$

$$H_2 = \frac{2\Delta s^2}{v^2\Delta t^2} + \frac{c\Delta s^2}{v^2\Delta t} - 2 \quad (10.9)$$

$$H_3 = \frac{\Delta s^2}{v^2\Delta t^2}. \quad (10.10)$$

Rod strings can be made up of various sections called tapers. A taper is defined by a rod diameter, length and material. Thus the H quantities must be pre-computed for each taper. When more complete definitions of quantities used in the H values are substituted, Propagation velocity:

$$v^2 = \frac{144\ Eg_c}{\rho} \quad (10.11)$$

Rod-fluid friction coefficient:

$$c = \frac{144\ c' g_c}{\rho A} \quad (10.12)$$

$$c' = \frac{\pi v \lambda \rho A}{288\ g_c L} \quad (10.13)$$

the H quantities are obtained for each taper.

The H values do not involve the C(x) and g(x) terms of equation (8). These are handled separately as discussed below.

The predictive and diagnostic problems are solved with different partial difference formulas. For the predictive problem (deviated SROD) it is necessary to step forward in time. Thus eq. (8) is solved for u(x,t+Δt). This yields a different set of H values than discussed above. Conditions at the down hole pump are known from a boundary condition in the predictive problem. For the diagnostic problem (deviated DIAG), it is necessary to compute pump conditions which are unknown. As shown above, equation (8) is solved for u(x+Δ,t). From a first boundary condition, the surface rod node position (at x=0) is known for all time t. From a second boundary condition and Hooke's Law, the rod positions at the second node (x=Δx) can also be calculated for all time t. This starts the solution and node positions all of the way to be pump can be calculated. This establishes pump load and position which comprise the down hole pump card.

Another H function, H4, is not involved in the format of the wave equation solution. It too is a pre-computed value which is only involved in applying the rod-tubing drag load.

Data concerning the Surface Card from box 306, the well friction coefficient from box 310, the H-factor from box 312 and well parameter data are applied to pump card generator 314. Computer modeling is used to construct the functions Q(x) and T(x). These functions describe the Coulomb drag friction between rods and tubing. The derivative in Eq. (8) is replaced with a finite difference, $$C(x) = \delta\mu(x)\left[Q(x) + T(x)\frac{u(x+\Delta x, t) - u(x, t)}{\Delta x}\right] \tag{9.1}$$

and the effect of Coulomb friction is incorporated into the partial difference solution with $$u(x+\Delta x,t)=H_1u(x,t+\Delta)-H_2u(x,t)H_3u(x,t-\Delta t)-u(x-\Delta s, t)+H_4C(x)$$

The finite difference approximation to the partial derivative in (8) is computed at the previous time step. This compromise avoids a mathematical difficulty but little loss in accuracy results. Computer processing time is decreased.

Pump cards for deviated and horizontal wells are generated according to equations 8, 9, 10 with the friction coefficient determined as described above. Pump cards for vertical wells are generated also according to equations 8, 9, 10, but with a friction coefficient suitable for a vertical well used rather than the procedure described above for a deviated well.

After the pump card is determined, it is analyzed to determine many pump parameters as indicated in box 318. Pattern recognition of the pump shape indicate possible pump problems as indicated in box 320. U.S. Pat. No. 6,857,474 to Bramlett et al. (incorporated herein) illustrates various down hole card shapes representative of various pump conditions.

The well manager generates a report as to well condition as indicated by report generator box 312 and transfers the report out and, via e-mail, sms, mms, etc, or makes it available for data query transmission scheme through wired or wireless transmission. See box 319. It also generates a control signal/command 65 to be applied or sent (wired or wireless) to the Electrical Panel 322 to switch ON/OFF the power that is applied to the pump 200 for its control depending on the analysis of the pump card.

The control can be a pump off signal/command 65 applied or sent (wired or wireless) to the electrical panel 322 of the pump 200 or a variable speed signal/command applied or send (wired or wireless) to a variable frequency drive 324 for example.

What is claimed is:

1. An instrumentation system for assessing operation of a reciprocating pump system producing hydrocarbons from a non-vertical wellbore which extends from the surface into the earth, the system comprising, a data gathering system which provides signals representative of surface operating characteristics of the pumping system, and characteristics of said non-vertical wellbore, a processor which receives said operating characteristics with said characteristics of said non-vertical wellbore and generates a surface card representative of surface polished rod load, as a function of surface polished rod position, with said processor determining a friction law function based on said characteristics of said non-vertical wellbore, and with said processor periodically generating a downhole pump card as a function of said surface card and said friction law function for a wave equation which describes the linear vibrations in a long slender rod, wherein the friction law function for the wave equation is represented as follows:

$$C(x) = \delta\mu(x)\left[Q(x) + T(x)\frac{\partial u(x, t)}{\partial x}\right], \text{ wherein}$$

$$\delta = \frac{\partial u(x, t)/\partial t}{|\partial u(x, t)/\partial t|}$$

t=time in seconds;

x=distance of a point on the unrestrained rod measured from the polished rod in feet, and where u(x), Q(x) and T(x) are determined by mathematical modeling of a rod string in said wellbore.

2. The system of claim 1 wherein, said processor includes pump card analysis software which produces a control signal for controlling said pump.

3. The system of claim 1 wherein, said pump card analysis software produces a control signal to turn off a drive motor of said pump if a pump card indicator is recognized requiring pump shut off.

4. The system of claim 1 wherein, said pump card analysis software produces a control signal to control a variable speed of the pump if a pump card indicator is recognized which indicates that varying the speed of the pump enhances pump operation.

* * * * *